US010117526B1

(12) United States Patent
Thompson

(10) Patent No.: US 10,117,526 B1
(45) Date of Patent: Nov. 6, 2018

(54) SEAFOOD SHOWCASE

(71) Applicant: James Thompson, Bay Saint Louis, MS (US)

(72) Inventor: James Thompson, Bay Saint Louis, MS (US)

( * ) Notice: Subject to any disclaimer, the term of this patent is extended or adjusted under 35 U.S.C. 154(b) by 0 days.

(21) Appl. No.: 15/787,817

(22) Filed: Oct. 19, 2017

(51) Int. Cl.

| | |
|---|---|
| ***A47F 3/00*** | (2006.01) |
| ***A47F 3/14*** | (2006.01) |
| ***A47F 7/00*** | (2006.01) |
| *A47F 3/04* | (2006.01) |

(52) U.S. Cl.
CPC ..... *A47F 3/14* (2013.01); *A47F 7/0071* (2013.01); *A47F 3/04* (2013.01)

(58) Field of Classification Search
CPC ..... A47F 3/04; A47F 3/14; A47F 7/0071
USPC ..... 312/115, 137; 62/440, 441, 458
See application file for complete search history.

(56) References Cited

U.S. PATENT DOCUMENTS

| | | | | |
|---|---|---|---|---|
| 1,805,565 A * | 5/1931 | Brooks | A47B 77/16 | 211/127.1 |
| 2,584,755 A * | 2/1952 | Stewart | A47F 5/005 | 220/533 |
| 3,320,964 A * | 5/1967 | Tripp | A47F 3/0495 | 134/100.1 |
| 3,395,550 A | 8/1968 | Dungan | | |
| 4,801,180 A * | 1/1989 | Styles | A47F 3/0469 | 160/241 |
| 4,899,487 A * | 2/1990 | Brownlee | A47F 7/0071 | 47/41.01 |
| 4,923,258 A * | 5/1990 | Styles | A47F 3/0469 | 160/241 |
| 5,605,056 A | 2/1997 | Brown et al. | | |
| 6,626,006 B1 | 9/2003 | Tedder | | |
| 2002/0043906 A1* | 4/2002 | Dewitt | A47F 3/007 | 312/137 |

* cited by examiner

*Primary Examiner* — James O Hansen

(57) ABSTRACT

A seafood showcase having a plurality of vertical dividers disposed on a bottom from a front wall to a rear wall, forming a plurality of sections. A plurality of perforated horizontal dividers is medially disposed on the bottom, bisecting each of the plurality of sections into a front compartment and a rear compartment. The front compartment has a drain, a perforated drain separator wall, and a perforated false bottom. The perforated false bottom is removably disposed on the bottom of the showcase within the front compartment, and the perforated false bottom has an at least one handle and a plurality of removable legs. A water feed system has a main line and a plurality of compartment lines with a first valve and a perforated dispersion mechanism. A plurality of vertical drainpipes is attached to the drain of the front compartment of each section of the plurality of sections.

2 Claims, 4 Drawing Sheets

SEAFOOD SHOWCASE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of coolers and showcases are known in the prior art. Non-refrigerated coolers depend on ice to stay cool, and thus have to deal with the melted water and comingling of seafood with the ice and water. Existing showcases create a messy mixture of water and seafood parts, and are difficult to maintain at a cold temperature without dumping ice on the seafood and hiding it from the customer's view. What is needed, and what the present seafood showcase provides, is a showcase having a plurality of sections having a front compartment and a rear compartment with a perforated horizontal divider separating them. A water flow system slowly feeds water into the rear compartment that is filled with ice, thus creating a flow of ice cold water into the front compartment with the seafood. The water then can slowly drain out of a drain in front compartment to create a constant flow of cold water, maintaining the seafood at an ideal 0° Celsius. What is also needed is a perforated false bottom in the front compartment to elevate the seafood and to allow debris and parts such as legs to sift to the bottom and stay separate from the goods delivered to the customer.

FIELD OF THE INVENTION

The present invention relates to non-refrigerated coolers and showcases, and more particularly, to a seafood showcase.

SUMMARY OF THE INVENTION

The general purpose of the present seafood showcase, described subsequently in greater detail, is to provide a seafood showcase that has many novel features that result in a seafood showcase that is not anticipated, rendered obvious, suggested, or even implied by prior art, either alone or in combination thereof.

To accomplish this, the present seafood showcase includes a showcase having a front wall, a left wall, a right wall, a rear wall, and a bottom. The rear wall has a first height greater than a second height of the left wall and the right wall, and the second height is greater than a third height of the front wall. This configuration creates an elevated, open topped container supported by three walls. The showcase can be an insulated material including, but not limited to, insulated fiberglass over urethane. A transparent splashguard is disposed on an outside of the rear wall such that it extends above a top edge of said rear wall. The transparent splashguard protects customers from being splashed by water in the showcase.

A plurality of vertical dividers is disposed on the bottom of the showcase from the front wall to the rear wall, wherein the plurality of vertical dividers forms a plurality of sections. There is a plurality of perforated horizontal dividers medially disposed on the bottom of the showcase perpendicular to the plurality of vertical dividers, wherein each perforated horizontal divider of the plurality of perforated horizontal dividers bisects a section of the plurality of sections. Each bisected section of the plurality of sections comprises a front compartment and a rear compartment.

The front compartment of each of the plurality of sections has a drain, a perforated drain separator wall, and a perforated false bottom. The drain is disposed in a front corner of the front compartment, and the perforated drain separator wall is diagonally disposed proximal the drain to prevent blockage. The perforated false bottom is removably disposed on the bottom of the showcase within the front compartment, and the perforated false bottom has an at least one handle and a plurality of removable legs. The front compartment is configured to store and display seafood, such as shrimp. Depending on the quantity of seafood to be displayed, the false bottom and the plurality of legs can be used to elevate the seafood within the front compartment. Ice can be placed beneath the false bottom.

A water feed system is used to fill the plurality of sections with water. The water feed system has a main line and a plurality of compartment lines, wherein the main line is disposed on an inside of the rear wall proximal the top edge thereof. Each of the plurality of compartment lines is disposed on the main line, and each of the plurality of compartment lines has a first valve and a perforated dispersion mechanism. The main line is attached to a water source and is configured to deliver water to each of the plurality of compartment lines through the perforated dispersion mechanism. The rear compartment of each section of the plurality of sections is filled with ice to create a reservoir of cold water. The cold water flows through to the front compartment of each section of the plurality of sections at the same rate at which fresh water is delivered through the perforated dispersion mechanism.

The water flows through the front compartment of each section of the plurality of sections and down the drain therewithin. A plurality of vertical drainpipes is disposed on an underside of the bottom of the showcase, and each vertical drainpipe of the plurality of vertical drainpipes is attached to the drain of the front compartment of each section of the plurality of sections. Each vertical drainpipe of the plurality of vertical drainpipes has a second valve, and is attached to a main drainpipe.

Thus have been broadly outlined the more important features of the present seafood showcase so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
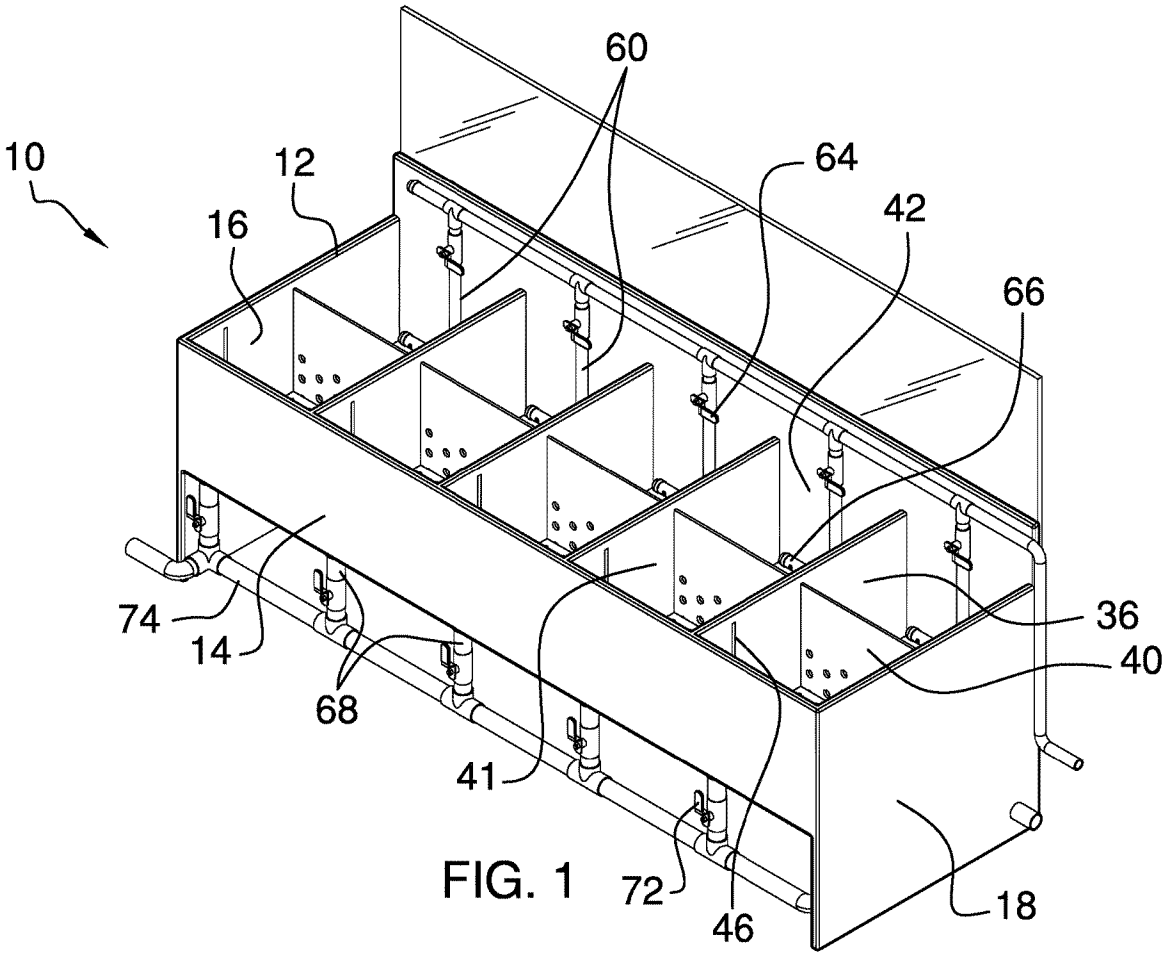
FIG. 1 is an isometric view of a seafood showcase.
Figure 2:
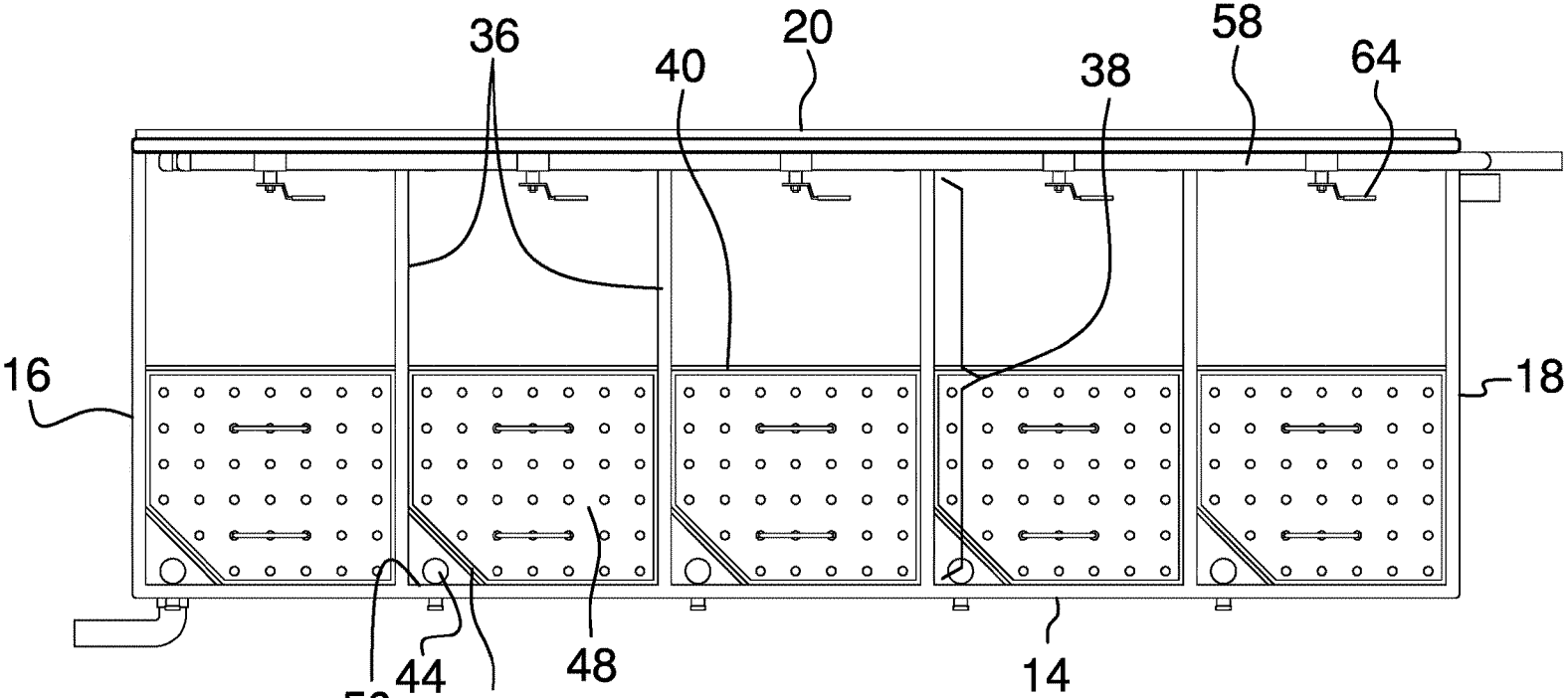
FIG. 2 is top plan view of the seafood showcase.
Figure 4:
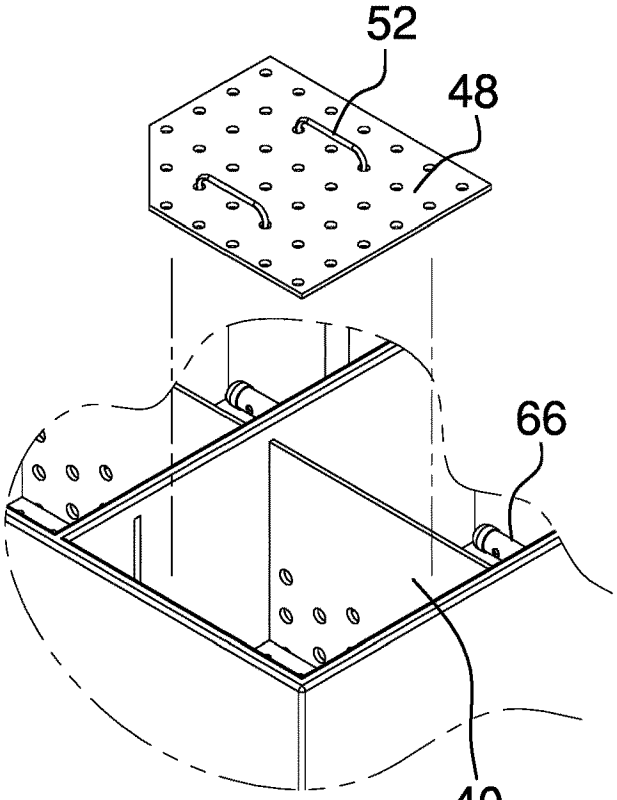
FIG. 4 is a detail isometric view of the seafood showcase.
Figure 3:
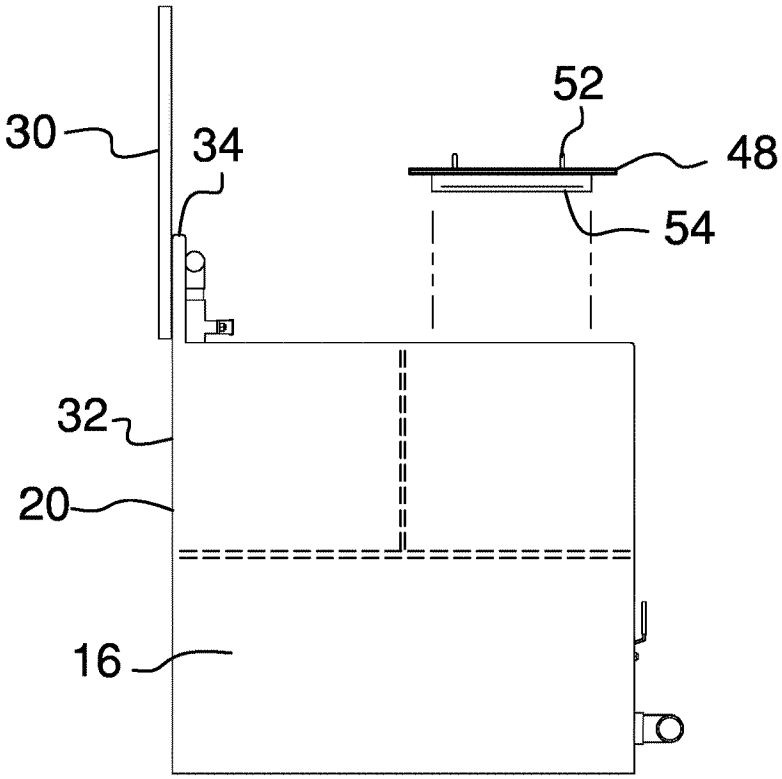
FIG. 3 is side elevation view of the seafood showcase.
Figure 5:
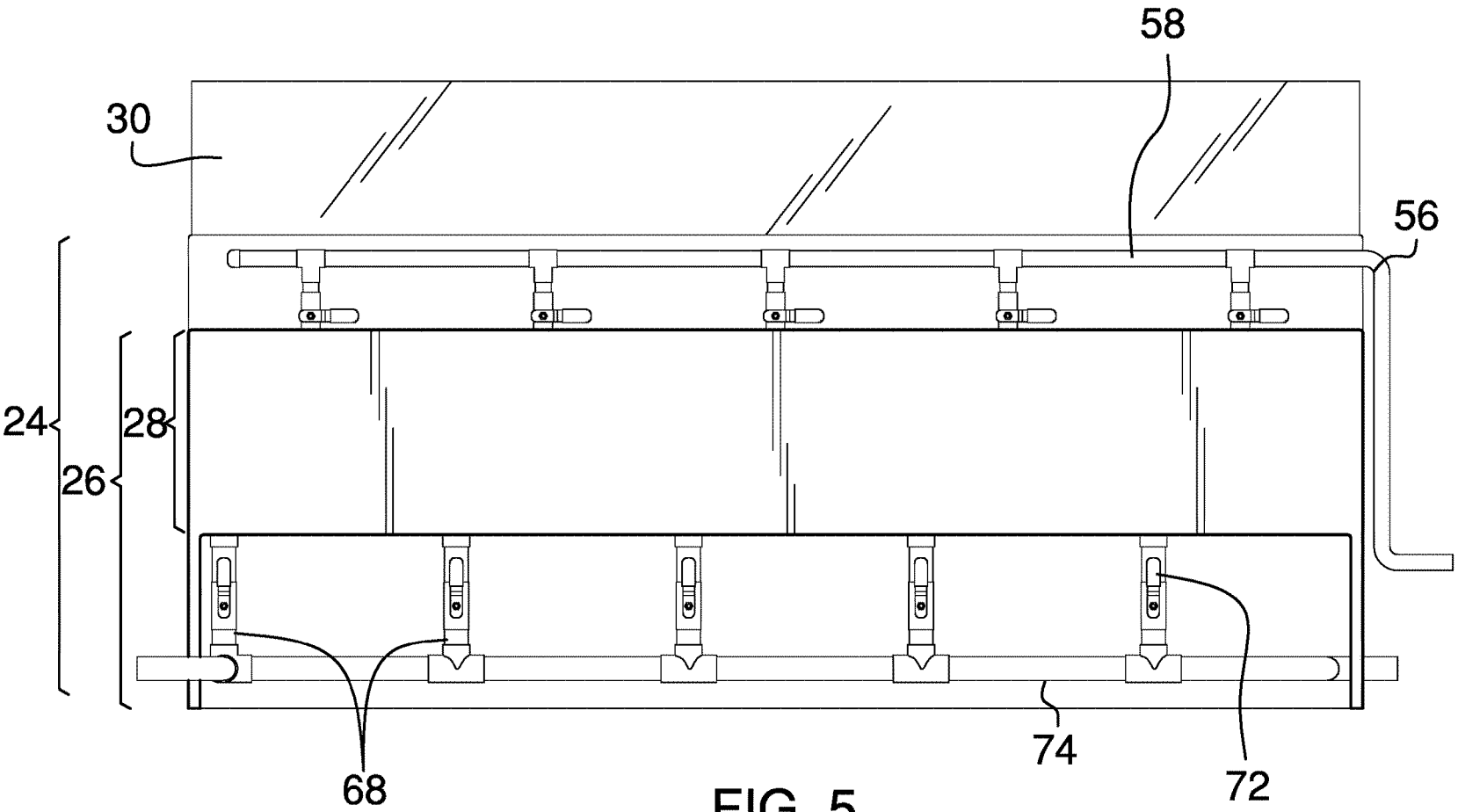
FIG. 5 is a front elevation view of the seafood showcase.

With reference now to the drawings, and in particular FIGS. 1 through 5 thereof, an example of the instant seafood showcase employing the principles and concepts of the present seafood showcase and generally designated by the reference number 10 will be described.

Referring to FIGS. 1 through 5 the present seafood showcase 10 is illustrated. The seafood showcase 10 includes a showcase 12 having a front wall 14, a left wall 16, a right wall 18, a rear wall 20, and a bottom 22. The rear wall has a first height 24 greater than a second height 26 of the left wall 16 and the right wall 18, and the second height 26 is greater than a third height 28 of the front wall 14. A transparent splashguard 30 is disposed on an outside 32 of the rear wall 20 such that it extends above a top edge 34 of said rear wall.

A plurality of vertical dividers 36 is disposed on the bottom 22 of the showcase from the front wall 14 to the rear wall 20, wherein the plurality of vertical dividers forms a plurality of sections 38. There is a plurality of perforated horizontal dividers 40 medially disposed on the bottom 22 of the showcase perpendicular to the plurality of vertical dividers 36, wherein each perforated horizontal divider of the plurality of perforated horizontal dividers bisects a section of the plurality of sections. Each bisected section of the plurality of sections comprises a front compartment 41 and a rear compartment 42.

The front compartment of each of the plurality of sections has a drain 44, a perforated drain separator wall 46, and a perforated false bottom 48. The drain is disposed in a front corner 50 of the front compartment 40, and the perforated drain separator wall is diagonally disposed proximal the drain. The perforated false bottom is removably disposed on the bottom 22 of the showcase within the front compartment, and the perforated false bottom has an at least one handle 52 and a plurality of removable legs 54.

A water feed system 56 is used to fill the plurality of sections 38 with water. The water feed system has a main line 58 and a plurality of compartment lines 60, wherein the main line is disposed on an inside 62 of the rear wall 20 proximal the top edge 34 thereof. Each of the plurality of compartment lines 60 is disposed on the main line 58, and each of the plurality of compartment lines has a first valve 64 and a perforated dispersion mechanism 66.

A plurality of vertical drainpipes 68 is disposed on an underside 70 of the bottom 22 of the showcase, and each vertical drainpipe of the plurality of vertical drainpipes is attached to the drain 44 of the front compartment of each section of the plurality of sections. Each vertical drainpipe of the plurality of vertical drainpipes has a second valve 72, and is attached to a main drainpipe 74.

What is claimed is:

1. A seafood showcase comprising:

a showcase having a front wall, a left wall, a right wall, a rear wall, and a bottom, wherein the rear wall has a first height greater than a second height of the left wall and the right wall, wherein the second height is greater than a third height of the front wall;

a transparent splashguard disposed on an outside of the rear wall such that it extends above a top edge of said rear wall;

a plurality of vertical dividers disposed on the bottom of the showcase from the front wall to the rear wall, wherein the plurality of vertical dividers forms a plurality of sections;

a plurality of perforated horizontal dividers medially disposed on the bottom of the showcase perpendicular to the plurality of vertical dividers, wherein each perforated horizontal divider of the plurality of perforated horizontal dividers bisects a section of the plurality of sections, wherein each bisected section of the plurality of sections comprises a front compartment and a rear compartment;

wherein the front compartment of each of the plurality of sections has a drain, a perforated drain separator wall, and a perforated false bottom, wherein the drain is disposed in a front corner of the front compartment, wherein the perforated drain separator wall is diagonally disposed proximal the drain, wherein the perforated false bottom is removably disposed on the bottom of the showcase within the front compartment, wherein the perforated false bottom has an at least one handle and a plurality of removable legs;

a water feed system having a main line and a plurality of compartment lines, wherein the main line is disposed on an inside of the rear wall proximal the top edge thereof, wherein each of the plurality of compartment lines is disposed on the main line, wherein each of the plurality of compartment lines has a first valve and a perforated dispersion mechanism, wherein the main line is attached to a water source and is configured to deliver water to each of the plurality of compartment lines;

a plurality of vertical drainpipes disposed on an underside of the bottom of the showcase, wherein each vertical drainpipe of the plurality of vertical drainpipes is attached to the drain of the front compartment of each section of the plurality of sections, wherein each vertical drainpipe of the plurality of vertical drainpipes has a second valve; and a main drainpipe attached to the plurality of vertical drainpipes.

2. The seafood showcase of claim 1 wherein the showcase is an insulated material.

* * * * *